United States Patent [19]

Jansen van Rensburg

[11] Patent Number: 4,940,349

[45] Date of Patent: Jul. 10, 1990

[54] GOLF CLUB CLEANER

[76] Inventor: Johannes C. Jansen van Rensburg, 16 Marion Pl., Glendower, Johannesburg, South Africa, 1610

[21] Appl. No.: 358,489

[22] Filed: May 30, 1989

Related U.S. Application Data

[63] Continuation of Ser. No. 68,622, Jul. 1, 1987, abandoned.

[30] Foreign Application Priority Data

Jul. 1, 1986 [ZA] South Africa ..... 86/4868

[51] Int. Cl.[5] ..... A46B 11/02

[52] U.S. Cl. ..... 401/10; 401/137; 401/269; 273/32 B

[58] Field of Search ..... 401/9, 10, 11, 137, 401/269; 273/32 B; 15/159 A, 160, 104, 92, 106, 206

[56] References Cited

U.S. PATENT DOCUMENTS

| | | | |
|---|---|---|---|
| 190,960 | 5/1877 | Davis | 15/160 |
| D. 191,299 | 9/1961 | Beban . | |
| D. 212,712 | 11/1968 | Godfrey . | |
| 1,742,929 | 1/1930 | Outshenikoff | 15/160 |
| 2,744,276 | 5/1956 | Chambless . | |
| 3,224,029 | 12/1965 | Domingos | 15/104.92 |
| 3,428,988 | 2/1969 | Blackburn | 401/10 X |
| 3,748,676 | 7/1973 | Warren et al. . | |
| 3,837,751 | 9/1974 | Ross | 15/206 X |
| 4,069,536 | 1/1978 | Hartz et al. | 15/160 X |
| 4,380,839 | 4/1983 | Caradonna | 15/160 X |
| 4,439,884 | 4/1984 | Giorni | 15/160 X |
| 4,464,072 | 8/1984 | Norwell | 401/137 |

FOREIGN PATENT DOCUMENTS

| | | | |
|---|---|---|---|
| 367841 | 1/1923 | Fed. Rep. of Germany | 15/206 |
| 673151 | 9/1929 | France | 15/206 |
| 252327 | 9/1948 | Switzerland | 401/269 |
| 676310 | 7/1952 | United Kingdom | 15/160 |
| 1246620 | 9/1971 | United Kingdom . | |
| 2177900 | 2/1987 | United Kingdom . | |

*Primary Examiner*—Steven A. Bratlie

*Attorney, Agent, or Firm*—Cushman, Darby & Cushman

[57] ABSTRACT

A manually grippable cleaner (10) is described which is suitable for cleaning golf clubs (17). The cleaner consists of a rectangular ring (12) which has internal bristles (22 and 24) and into which the head (66) of a club may be inserted. A cranked handle (30) carries the ring. Thus with the club head in the ring, relative reciprocation between the ring and the club head will cause the club head to be cleaned by the bristles. A outside set of bristles (28) is provided for cleaning "woods". The handle is hollow and comprises a chamber (33) for cleaning fluid. A pump (34) pumps the fluid to a nozzle (39) to be sprayed on to the club face.

7 Claims, 3 Drawing Sheets

Figure 3:
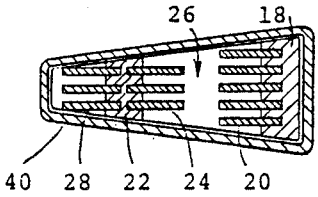

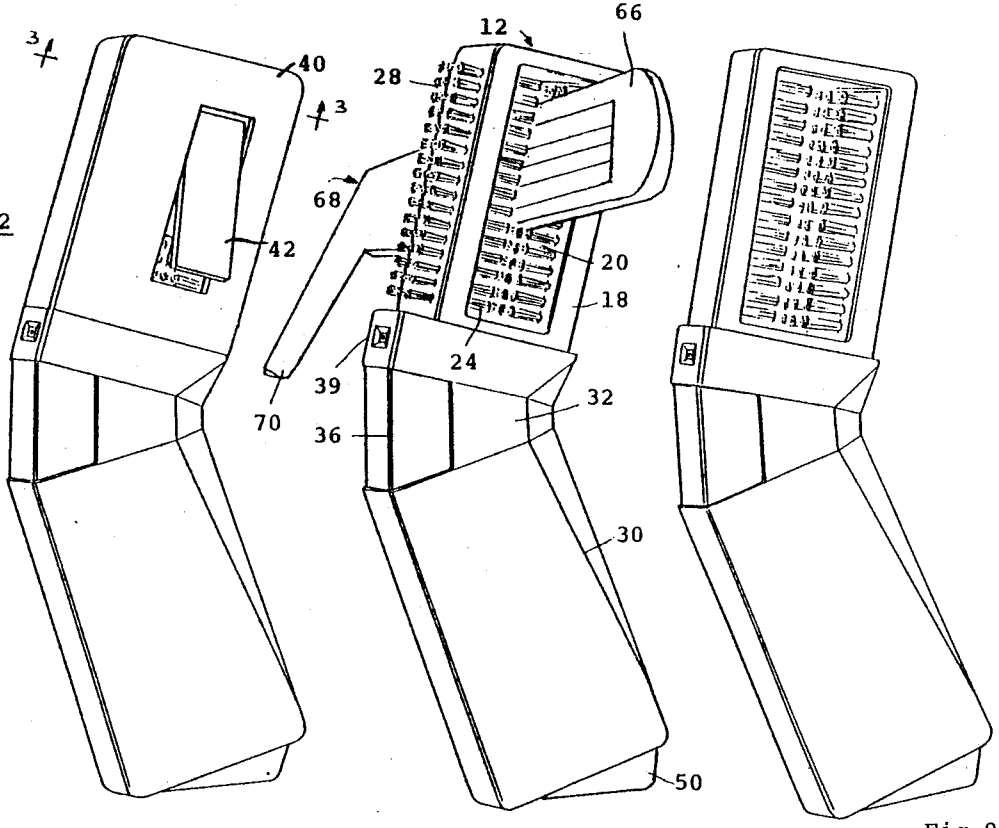
Fig 9
Fig 1
Fig 2
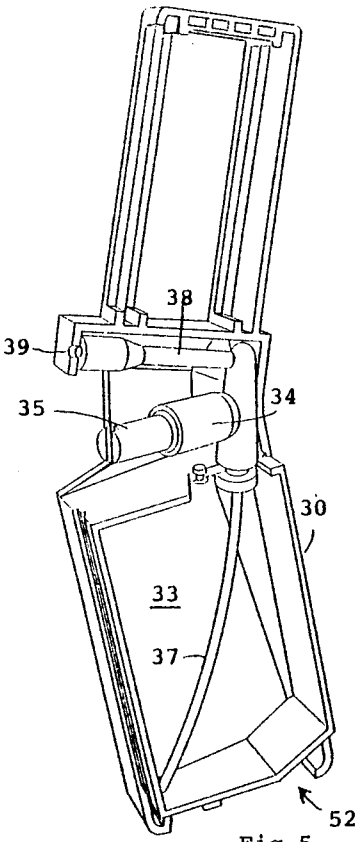
Fig 5

GOLF CLUB CLEANER

This is a continuation of application No. 068,622, filed Jul. 1, 1987, which was abandoned upon the filing hereof.

This invention relates to cleaners and in particular cleaners for golf clubs.

In use, golf clubs tend to become rather dirty due to the fact that the club strikes the turf or for any other reason. As this may affect the way in which the club directs the golf ball or imparts spin thereto, it is of importance to good players to keep the club face clean and clear of such turf or other dirt.

According to one aspect of the invention there is provided a cleaner for golf clubs comprising a container within which are mounted bristles or bristle like members (both of which are referred to as "bristles" hereafter unless clear from the context) and which has an opening into which the head of a golf club may be inserted, whereby on reciprocating the golf club with the head in the container, the head may be cleaned by the bristles.

The container is preferably in the form of a ring, preferably a rectangular ring, through which the base of the club can pass and preferably has a handle whereby the ring may be supported. This handle is preferably inclined or cranked relative to the ring to accomodate handling of the parts bearing in mind the fact that the club head is normally inclined to the club shaft.

The thickness of the ring is such that at least one of its walls can support a number, conveniently three, rows of bristles thereon. In one embodiment, there are a set, also conveniently comprising three rows, of bristles supported on the outside of the ring to provide an outside brush.

The handle preferably comprises a chamber in which cleaning fluid may be contained and includes a nozzle and pump means whereby the cleaning fluid may be pumped from the chamber to be expelled through the nozzle.

A cover is preferably provided for the ring to protect the bristles when not in use. This cover may have a carrying clip formed in its side so that it may be clipped on to the side of a golf bag for carrying purposes.

A holding clip is preferably provided in the base of the handle whereby a towel or the like may be held thereby.

Embodiments of the invention will now be described by way of example with reference to the accompanying drawings.

Figure 4:
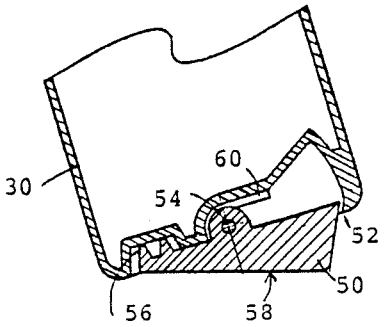
Figures 6A, 6B, 6C:
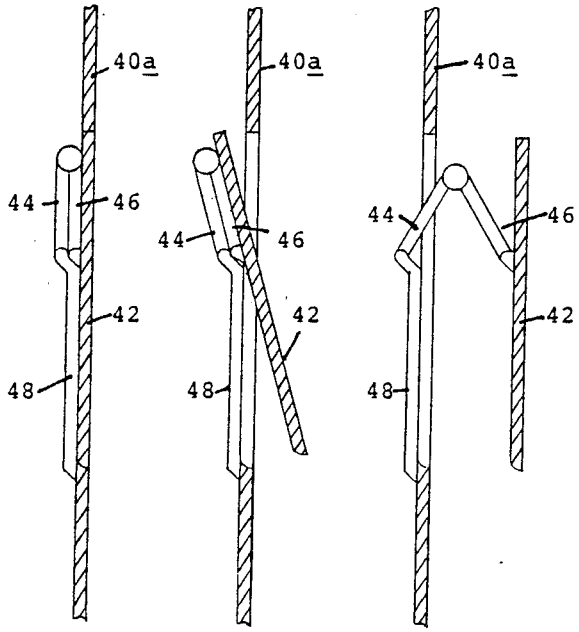
Figure 8:
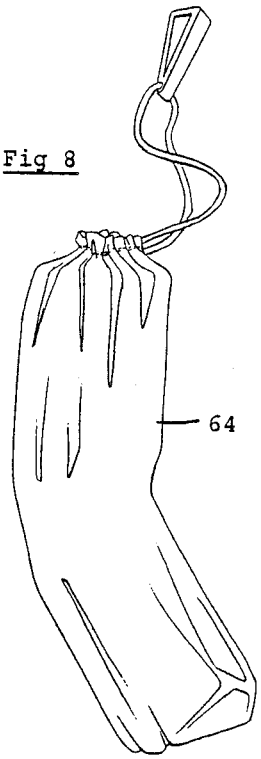
Figure 7:
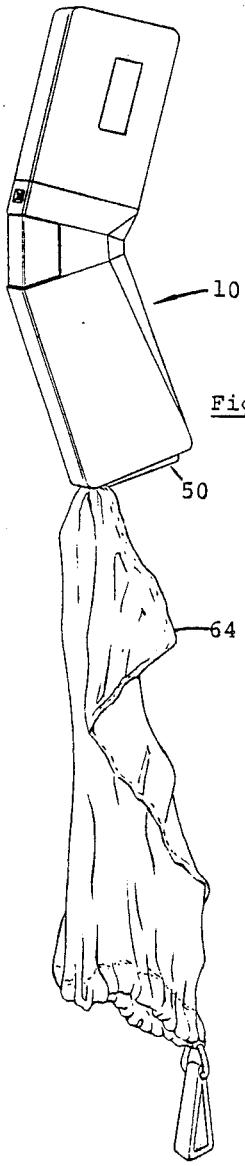

In the drawings:

FIG. 1 is a perspective view of a golf club cleaner of the invention cleaning the blade of a golf club, FIG. 2 is a similar view of the cleaner with the cover in position, FIG. 3 is a section on line 3—3 of FIG. 2 (but with the golf club head omitted), FIG. 4 is a detail section through the lower end of the handle showing the holding clip, FIG. 5 shows an open half of the cleaner, FIGS. 6*a*, 6*b* and 6*c* are sections through the cover showing the carrying clip in a number of positions, FIGS. 7 and 8 are perspective views showing the cleaner with a carrier bag therefor, and within the bag FIG. 9 is a view similar to FIG. 1 of a modified cleaner of the invention.

Referring now to the drawings, there is provided a cleaner 10 for golf clubs. The cleaner is a plastic moulding having two halves (one of which halves does not carry the bristles and is shown in FIG. 5). The cleaner 10 comprises a bristle container 12 in the form of a rectangular ring within which are mounted inwardly directed bristles. The ring 12 has in effect an opening 16 into which the blade of a golf club 17 may be inserted transversely to the ring for the purpose which will be discussed below.

The cleaner 10 is in the shape of the frustum of a triangle in section (best shown in FIG. 3). The width of the one wall (hereinafter called the "inner wall") 18 of the ring 12 is such that its inwardly directed surface supports five rows of bristles 20 thereof running from the upper to the lower part thereof. The other wall 22 is rather narrower than the wall 18 and its inwardly directed surface supports three rows of bristles 24. The ends of the bristles 20 and 24 are close together to form a narrow gap 26. The outer surface of the outer wall 22 also carries three rows of bristles 28.

The ring 12 has a plinth part to which is secured a handle 30 that is of the same order of size as the ring 12. The ring 12 is connected to the handle 30 through an intermediary part 32 so that the handle 30 is inclined or cranked relative to the ring 12. The handle 30 is hollow (see FIG. 5) and comprises a chamber 33 in which cleaning fluid may be contained. A pump 34 acts on the contents of the chamber 33 with its piston rod 35 being actuated by a manually compressible handle 36 (See FIGS. 1 and 2) at the forward end of the intrermediary part 32. The pump 34 has an hydraulic inlet conduit 27 and an hydraulic outlet conduit 38, the latter leading to a discharge nozzle 39 provided at the front face of the intermediary part 32. A suitable opening (not shown) is provided for filling the chamber 33.

The corners of the rear end of the cleaner 10 and the intermediary part 32 are tapered to make it easier to grip the handle 30.

A hollow parallelipipedal cover 40 is provided for the ring 12 to protect the bristles when not in use. This cover is firmly clipped on to the intermediary part to be held thereon until intentionally removed therefrom. A carrying clip 42 (shown partially open in FIG. 2) is formed in one side of the cover 40. As is best shown in FIG. 6*a*, the clip 42 lies flush with the wall 40*a* of the cover 40 when not in use. It is connected to a pair of spring arms 44 and 46 which are pivotally connected to a member 48 on the inside of the cover 40 so as to be movable to a position parallel to the wall 40*a* (see FIG. 6*c*).

By means of the carrying clip 42, the cover 40 and with it the entire cleaner may be clipped on to the side of a golf bag (not shown) to be carried thereby.

A holding clip 50 is provided in the base 52 of the handle (as best shown in FIG. 4). The base 52 is shaped to accomodate the clip 50 in its normal position (as shown) and its open position. The clip 50 is centrally pivotted at 54 and has a pair of gripping teeth 56 at one end. The other end of the clip is of larger dimensions and has an outside surface 58 which is flat and provides a support surface for the cleaner on which it can stand if desired. A spring (only partially shown at 60) is provided to urge the clip 50 into its normal position so that the teeth 56 can grip a member such as a towel against the bottom surface of a recess 62 at the base 52.

Instead of a towel, the clip 50 can be attached to the inside of a bag 64 (as shown in FIG. 7) that can be swung about to contain the cleaner 10 (as seen in FIG. 8) when the latter is not in use.

The cleaner can be used to clean the blade 66 of the golf clubs known as "irons", with the bristles 20 cleaning the rear face and the bristles 22 cleaning the front face. As is known the blade 66 of an "iron" is cranked or inclined to the club shaft 70. Because the handle 30 is cranked relative to the ring 12, this cranking is accomodated when using the cleaner 10 which can be easily moved over the club head 66.

The outside bristles 28 can be used for cleaning the face of a "wood".

The cleaning fluid within the chamber 33 handle can be sprayed on to the club face before cleaning by pumping on the handle 36 and directing the nozzle 39 towards the club face.

The invention is not limited to the precise constructional details hereinbefore described and illustrated. For example one or both of the clips 42 or 50 may be ommitted. Further the outer bristles 28 may be ommitted as is shown in FIG. 9.

In this specification where two items are stated to be "of the same order of size" it is intended to mean that one of the items has at least one dimension, but perferably more dimensions, that is between about three quarters to about twice that of the corresponding dimension of the other item.

I claim:

1. A portable, manually manipulatable grippable golf club blade cleaner comprising:

a member of generally rectangular section having longer end surfaces and shorter side faces, said member being formed into an open generally rectangular ring which has a pair of parallel longer sides respectively with inner surfaces that face another, said end surfaces constituting respectively said inner surfaces as well as outer surfaces of the ring, internal bristles formed on at least one of said inner surfaces but not the said side faces and having free ends which terminate along a given plane for cleaning said golf club blade when inserted between said inner surfaces, a handle which is inclined relative to said plane and which is of the same order of size as the ring for supporting the latter, and a cleaning fluid chamber and pump means both incorporated in said handle for pumping cleaning fluid from said chamber onto said club blade, the arrangement being such that, with the blade of the club head in the ring, relative reciprocation between the ring and the club head, the latter will be cleaned by the bristles.

2. A portable, manually manipulatable grippable golf club cleaner comprising:

a. a member of generally rectangular section having longer end surfaces and shorter side faces, said member being formed into an open generally rectangular ring which has a pair of parallel longer sides respectively with inner surfaces that face one another, said end surfaces constituting respectively said inner surfaces as well as outer surfaces of the ring, b. internal bristles formed on the said inner surfaces but not the said side faces and having free ends which terminate along a given plane and between which bristles the blade of a club may be inserted, c. a handle which is inclined relative to said plane and which is of the same order of size as the ring for supporting the latter, and d. a cleaning fluid chamber and pump means both incorporated in said handle for pumping cleaning fluid from said chamber onto said club blade, the arrangement being such that, with the blade of the club head in the ring, relative reciprocation between the ring and the club head, the latter will be cleaned by the bristles.

3. A cleaner as claimed in claim 2 in which the thickness of one internal wall of the ring is greater than the other, and in which more rows of bristles are provided on the thicker wall than on the thinner wall.

4. A cleaner as claimed in claim 2 further comprising a plurality of rows of bristles mounted on at least one external wall of the ring.

5. A cleaner as claimed in claim 2 in which the handle is hollow to define said chamber for containing said cleaning fluid, the handle including a nozzle and being hand compressible to operate said pump means to expel said cleaning fluid from the chamber through the nozzle.

6. A cleaner as claimed in claim 2, further comprising:

a removable cover for the ring to protect the bristles when not in use in which the cover has a flat front face and further comprising a clip forming part of the front face of the cover and attachment means securing the clip to the cover and being capable of moving the clip to a position parallel to the said front face.

7. A cleaner as claimed in claim 5 in which the pump has a handle member having outside surfaces that form a substantial continuation of the surfaces of the handle.

* * * * *